US008281425B2

(12) United States Patent
Cohen

(10) Patent No.: US 8,281,425 B2
(45) Date of Patent: Oct. 9, 2012

(54) LOAD SENSOR SAFETY VACUUM RELEASE SYSTEM

(76) Inventor: Joseph D. Cohen, Aurora, CO (US)

( * ) Notice: Subject to any disclaimer, the term of this patent is extended or adjusted under 35 U.S.C. 154(b) by 404 days.

(21) Appl. No.: 11/163,860

(22) Filed: Nov. 1, 2005

(65) Prior Publication Data

US 2006/0090255 A1 May 4, 2006

Related U.S. Application Data

(60) Provisional application No. 60/623,634, filed on Nov. 1, 2004.

(51) Int. Cl.
*E04H 4/00* (2006.01)

(52) U.S. Cl. ..... 4/504; 4/509; 417/44.2

(58) Field of Classification Search ..... 4/504, 509, 4/541.2; 417/44.1, 44.2; 361/79
See application file for complete search history.

(56) References Cited

U.S. PATENT DOCUMENTS

| | | | | |
|---|---|---|---|---|
| 1,061,919 | A | 5/1913 | Miller | |
| 3,191,935 | A | 6/1956 | Uecker | |
| 2,767,277 | A | 10/1956 | Wirth | |
| 3,558,910 | A | 1/1971 | Dale et al. | |
| 3,781,925 | A | 1/1974 | Curtis et al. | |
| 3,838,597 | A | 10/1974 | Montgomery et al. | |
| 3,953,777 | A | 4/1976 | McKee | |
| 3,963,375 | A | 6/1976 | Curtis | |
| 4,021,700 | A | 5/1977 | Ellis-Anwyl | |
| 4,123,792 | A | 10/1978 | Gephart | 361/30 |
| 4,168,413 | A | 9/1979 | Halpine | |
| 4,185,187 | A | 1/1980 | Rogers | |
| 4,319,712 | A | 3/1982 | Bar | |
| 4,370,098 | A | 1/1983 | McClain et al. | |
| 4,371,315 | A | 2/1983 | Shikasho | |
| 4,419,625 | A | 12/1983 | Bejot | 324/142 |
| 4,420,787 | A | 12/1983 | Tibbits et al. | |
| 4,428,434 | A | 1/1984 | Gelaude | |
| 4,449,260 | A | 5/1984 | Whitaker | |
| 4,473,338 | A | 9/1984 | Garmong | |
| 4,504,773 | A | 3/1985 | Suzuki et al. | |
| 4,505,643 | A | 3/1985 | Millis et al. | |
| 4,514,989 | A | 5/1985 | Mount | |
| 4,541,029 | A * | 9/1985 | Ohyama | 361/31 |
| 4,581,900 | A | 4/1986 | Lowe et al. | |
| 4,620,835 | A * | 11/1986 | Bell | 417/17 |
| 4,647,825 | A | 3/1987 | Profio et al. | |

(Continued)

FOREIGN PATENT DOCUMENTS

DE 2946049 5/1981

(Continued)

OTHER PUBLICATIONS

Fail-Safe, LLC, Save Lives! Use Fail-Safe Suction-Safe Pool and Spa Pumps, brochure, Dec. 31, 2000, 4 pages, Aurora, Colorado.

(Continued)

*Primary Examiner* — Tuan Nguyen

(57) ABSTRACT

A motor with associated load sensor is connected to a circulation pump of a swimming pool circulation system. The load sensor performs the function of a safety vacuum release system by detecting underload of the motor. Underload is now discovered to be reliably indicative of blockage on the intake side of a circulation pump. A switch controlled by the load sensor shuts off the motor in response to a suitable underload. Vacuum on the intake side of the circulation pump neutralizes, thereby freeing a person or object blocking the suction line.

10 Claims, 2 Drawing Sheets

U.S. PATENT DOCUMENTS 4,676,914 A 6/1987 Mills et al.
4,678,404 A 7/1987 Lorett et al.
4,695,779 A 9/1987 Yates
4,697,464 A 10/1987 Martin
4,703,387 A * 10/1987 Miller ..... 361/79
4,758,697 A 7/1988 Jeuneu
4,837,656 A 6/1989 Barnes et al.
4,839,571 A 6/1989 Farnham et al.
4,841,404 A 6/1989 Marshall et al.
4,864,287 A 9/1989 Kierstead
4,885,655 A 12/1989 Springer et al.
4,896,101 A 1/1990 Cobb
4,907,610 A 3/1990 Meincke
4,971,522 A 11/1990 Butlin
4,996,646 A 2/1991 Farrington
4,998,097 A 3/1991 Noth et al.
5,079,784 A 1/1992 Rist et al.
5,100,298 A 3/1992 Shibata et al.
RE33,874 E 4/1992 Miller ..... 361/79
5,167,041 A 12/1992 Burkitt
5,172,089 A 12/1992 Wright et al.
5,234,286 A 8/1993 Wagner
5,255,148 A 10/1993 Yeh
5,324,170 A 6/1994 Anastos et al.
5,347,664 A 9/1994 Hamza et al.
5,361,215 A 11/1994 Tompkins et al.
5,422,014 A 6/1995 Allen et al.
5,473,497 A 12/1995 Beatty ..... 361/23
5,545,012 A 8/1996 Anastos et al.
5,548,854 A 8/1996 Bloemer et al.
5,550,753 A 8/1996 Tompkins et al.
5,559,720 A 9/1996 Tompkins et al.
5,570,481 A 11/1996 Mathis et al.
5,577,890 A 11/1996 Nielsen et al.
5,601,413 A 2/1997 Langley et al.
5,624,237 A 4/1997 Prescott et al.
5,632,468 A 5/1997 Schoenmeyr
5,633,540 A 5/1997 Moan
5,682,624 A 11/1997 Ciochetti ..... 4/509
5,690,476 A 11/1997 Miller
5,727,933 A 3/1998 Laskaris et al.
5,777,833 A 7/1998 Romillon
5,820,350 A 10/1998 Mantey et al.
5,833,437 A 11/1998 Kurth et al.
5,907,281 A 5/1999 Miller et al.
5,930,092 A 7/1999 Nystrom
5,947,700 A 9/1999 McKain et al.
5,959,534 A 9/1999 Campbell et al.
5,991,939 A 11/1999 Mulvey ..... 4/504
6,043,461 A 3/2000 Holling et al.
6,045,333 A 4/2000 Breit
6,059,536 A 5/2000 Stingl ..... 417/44.2
6,092,992 A 7/2000 Imbium et al.
6,098,654 A 8/2000 Cohen ..... 137/467
6,157,304 A 12/2000 Bennett et al.
6,171,073 B1 1/2001 McKain et al.
6,199,224 B1 3/2001 Versland
6,213,724 B1 4/2001 Haugen et al.
6,216,814 B1 4/2001 Fujita et al.
6,238,188 B1 5/2001 Lifson
6,251,285 B1 6/2001 Ciochetti
6,253,227 B1 6/2001 Tompkins et al.
6,342,841 B1 1/2002 Stingl ..... 340/626
6,354,805 B1 3/2002 Moller
6,364,621 B1 4/2002 Yamauchi
6,390,781 B1 5/2002 McDonough
6,468,042 B2 10/2002 Moller
6,468,052 B2 10/2002 McKain et al.
6,481,973 B1 11/2002 Struthers
6,501,629 B1 12/2002 Marriott
6,504,338 B1 1/2003 Eichorn
6,522,034 B1 2/2003 Nakayama
6,534,947 B2 3/2003 Johnson et al.
6,543,940 B2 4/2003 Chu
6,590,188 B2 7/2003 Cline et al.
6,595,762 B2 7/2003 Khanwilkar et al.
6,616,413 B2 9/2003 Humpheries
6,623,245 B2 9/2003 Meza et al.
6,636,135 B1 10/2003 Vetter
6,638,023 B2 10/2003 Scott
6,676,831 B2 1/2004 Wolfe
6,696,676 B1 2/2004 Graves et al.
6,709,240 B1 3/2004 Schmalz et al.
6,715,996 B2 4/2004 Moeller
6,732,387 B1 5/2004 Waldron
6,768,279 B1 7/2004 Skinner et al.
6,779,205 B2 8/2004 Mulvey et al.
6,806,677 B2 10/2004 Kelly et al.
6,875,961 B1 4/2005 Collins
6,895,608 B2 5/2005 Goettl
6,933,693 B2 8/2005 Schuchmann
6,941,785 B2 9/2005 Haynes et al.
6,965,815 B1 11/2005 Tompkins et al.
6,976,052 B2 12/2005 Tompkins et al.
7,055,189 B2 6/2006 Goettl
7,117,120 B2 10/2006 Beck et al.
7,163,380 B2 1/2007 Jones
7,327,275 B2 2/2008 Brochu et al.
2001/0029407 A1 10/2001 Tompkins et al.
2002/0176783 A1 11/2002 Moeller
2002/0190687 A1 12/2002 Bell et al.
2003/0106147 A1 6/2003 Cohen ..... 4/504
2004/0009075 A1 1/2004 Meza et al.
2004/0062658 A1 4/2004 Beck et al.
2004/0090197 A1 5/2004 Schuchmann
2004/0205886 A1 10/2004 Goettl
2004/0213676 A1 10/2004 Phillips et al.
2005/0097665 A1 5/2005 Goettl
2005/0123408 A1 6/2005 Koehl
2005/0133088 A1 6/2005 Bologeorges
2005/0158177 A1 7/2005 Mehlhorn
2005/0193485 A1 9/2005 Wolfe
2005/0226731 A1 10/2005 Mehlhorn et al.
2005/0281681 A1 12/2005 Anderson et al.
2006/0045750 A1 3/2006 Stiles
2006/0127227 A1 6/2006 Mehlhorn et al.
2006/0146462 A1 7/2006 McMillian
2007/0114162 A1 5/2007 Stiles et al.
2007/0154319 A1 7/2007 Stiles et al.
2007/0154320 A1 7/2007 Stiles et al.
2007/0154321 A1 7/2007 Stiles et al.
2007/0154322 A1 7/2007 Stiles et al.
2007/0154323 A1 7/2007 Stiles et al.
2007/0163929 A1 7/2007 Stiles et al.
2007/0183902 A1 8/2007 Stiles, Jr. et al.
2008/0003114 A1 1/2008 Levin et al.
2008/0041839 A1 2/2008 Tran
2008/0063535 A1 3/2008 Koehl
2008/0095638 A1 4/2008 Branecky
2008/0095639 A1 4/2008 Bartos et al.
2008/0095640 A1 4/2008 Branecky et al.
2008/0168599 A1 7/2008 Caudill et al.
2009/0280014 A1 11/2009 Branecky
2009/0288407 A1 11/2009 Bartos et al.
2009/0290989 A1 11/2009 Mehlhorn et al.
2009/0290990 A1 11/2009 Branecky
2009/0290991 A1 11/2009 Mehlhorn et al.
2010/0068073 A1 3/2010 Branecky
2010/0080714 A1 4/2010 Mehlhorn et al.
2010/0232981 A1 9/2010 Branecky et al.
2011/0002792 A1 1/2011 Bartos et al.

FOREIGN PATENT DOCUMENTS

DE 19736079 2/1999
EP 0150068 7/1985
EP 0226858 7/1987
EP 0246769 11/1987
EP 0833436 4/1998
JP 55072678 5/1980
WO 2005011473 2/2005
WO 2010039580 4/2010

OTHER PUBLICATIONS

Fail-Safe, LLC, Suction-Safe Pool & spa Pump Operator's Manual, brochure, Apr. 8, 2003, 12 pages, Aurora, Colorado .
Cohen, signed letter to Sheldon L. Wolfe, 1 page, Oct. 6, 2007.

Fail-Safe, LLC and Sta-Rite Industries, Inc., Non-Disclosure Agreement, 3 pages, Feb. 3, 1998.
Author Unknown, Safety Vacuum Release Valve from Fail Safe, 1 page, date unknown.
Author Unknown, Request for Lab Project, 3 pages, Sep. 2, 1999.
Cohen, Signed letter to Gary Brooks, 1 page, Sep. 2, 1999.
Author Unknown, "Suction Safe" Swimming Pool Pump: Simulated Field Test, 3 pages, Sep. 2, 1999.
Author Unknown, General Worksheet, 3 pages, Oct. 5, 1999.
Meyer, Memo re Orifices for Fail-Safe Assembly, 1 page, Oct. 14, 1999.
Sta-Rite Industries, Inc. 60 Cycle "C" and "CC" Series Centrifugal Pumps for Swimming Pool Use, 16 pages, Dec. 10, 2002.
Stadtmueller, Order re Case No. 08-CV-310, United States District Court Eastern District of Wisconson, Sep. 3, 2010.
Long, Brief of Plaintiff-Appellant Fail-Safe, LLC, The United States Court of Appeals for the Seventh Circuit, Aug. 26, 2011.
Long, Reply Brief of Plaintiff-Appellant Fail-Safe, LLC, The United States Court of Appeals for the Seventh Circuit, Sep. 10, 2011.
United States Court of Appeals, Opinion, Mar. 29, 2012.
Best, Corrected Brief of Defendent-Appellee A.O. Smith Corporation, Nov. 14, 2011.

* cited by examiner

LOAD SENSOR SAFETY VACUUM RELEASE SYSTEM

BACKGROUND OF THE INVENTION

1. Field of the Invention

The invention generally relates to pumps and to condition responsive control of a pump drive motor. The invention also generally relates to hydrotherapy spas and swimming pools, with a condition responsive means for agitating or circulating water in the pool. The invention also generally relates to electrical communications and to a condition responsive indicating system. More specifically, the invention relates to detection of an underload condition in a swimming pool circulation pump motor and a responsive shutdown of the pump motor.

2. Description of Related Art Including Information Disclosed Under 37 CFR 1.97 and 1.98

Swimming pools and other aquatic facilities require a circulation system to remove water, filter the water, optionally heat the water, and return the processed water to the facility. A circulation pump draws water from the facility under vacuum, also called "negative pressure," and pumps the water under positive pressure back to the facility. The circulation pump is powerful and produces considerable negative pressure at the connection of any of various pump intake pipes within the pool.

Pools are designed to provide several pump intake points so that the pump can draw from any or all of them. These pump intake points are referred to as suction outlet fittings. If any one suction outlet fitting becomes clogged, the pump draws from the others. In turn, if a bather covers any one of the pump intake points, he should not be held to it by excessive vacuum. Yet, various accidents take place wherein a bather is trapped against a pump intake point by high suction or negative pressure. The possible reasons for this result are many, including poor initial design and construction of the circulation system, or the other intake points may be clogged or simultaneously blocked. Swimming pools should be equipped with a fast-action safety system to release the trapped bather before he might drown or suffer other injury. A safety system of this type is referred to as a Safety Vacuum Release System or, as a shorthand term, SVRS.

Several different types of SVRS are known, each operating in a different manner. The most consistent factor is that they operate by monitoring the vacuum level within the circulation pump intake pipe. A suction entrapment event always is accompanied by an abrupt increase in vacuum level within the circulation pump intake pipe. If the system detects an abrupt increase in vacuum, it actuates a release mechanism. Three general types of release mechanisms are known.

In the first type of release mechanism, the pump can be shut off. Two patents demonstrate that vacuum level can be monitored and used to indicate when a circulation pump should be shut off. U.S. Pat. No. 6,059,536 to Stingl shows an emergency shutdown system in which a vacuum switch is connected to a pump shutoff switch. In case of blockage or a suction entrapment event, the vacuum switch senses the increase in vacuum and triggers the shutoff switch to cut off line current to the circulation pump. As a result, the high vacuum dissipates and releases the bather or other blockage. U.S. Pat. No. 6,342,841 to Stingl shows another emergency shutdown system wherein a microcontroller stores various vacuum profiles for various modes of operation. A comparator within the processor compares real time vacuum data with a stored profile. In case of a detected deviation from the profile, the processor signals the pump, relay to shutdown the circulation pump. Thus, several methods allow an increase in sensed intake vacuum to shut down a circulation pump to allow vacuum level to neutralize.

In a second type of release mechanism, the suction line is vented to atmosphere in order to neutralize the vacuum. U.S. Pat. No. 5,682,624 to Ciochetti shows a valve mounted to a suction line. The valve opens in response to a predetermined high vacuum level in the suction line to vent air into the line, breaking the vacuum and causing the circulation pump to lose prime. U.S. Pat. No. 5,991,939 to Mulvey shows a specific valve in a four-port fixture. Water from the suction inlet pipe flows through two aligned ports. If the suction level becomes higher than a predetermined value, cross-ports open to admit air. U.S. Pat. No. 6,098,654 to Cohen shows another specific valve that is installed in a suction line. The valve opens to admit atmosphere in response to predetermined high vacuum level, and a spring ensures that the valve fully opens for rapid action. Venting the circulation system is effective but carries certain drawbacks. Among them, the pump loses prime, which increases the difficulty in restarting the system. Another drawback is that the pump may run dry, which can damage the pump.

In a third type of release mechanism, a device monitors vacuum in the suction line and responds to the detection of a high vacuum level by reversing the direction of water flow in the suction line. United States published patent application 20030106147 to Cohen et al. shows a system for converting high vacuum level into a positive reverse pressure. The direction of water flow is reversed, thus propelling the victim away from the suction outlet fitting by positive force. This type of system offers a high degree of safety but has the drawback of requiring considerable extra equipment and corresponding room to house such equipment.

A problem exists in the retrofit market for updating older circulation systems with SVRS technology. Known SVRS systems require the addition of significant new equipment to an existing circulation system. Often there is not room for the additions within existing housings, which then requires expensive updating.

It would be desirable to have an effective SVRS system that requires substantially no additions in order to retrofit a circulation system that previously had no SVRS system. Similarly, it would be desirable to have an effective retrofit SVRS system that fits within the existing housing of a system not designed to receive a SVRS.

Circulation systems are present in substantially all aquatic facilities. Such systems are necessary for filtration, sanitization, heating, hydrotherapy, and the operation of water features such as decorative fountains. A circulation pump provides the water flow within these circulation systems. An electric motor is connected to the pump to provide motive power. The invention provides a new method of sensing and responding to blockage or bather entrapment. The new method adapts a motor with supplemental or integral load-sensing capability to sense when the suction intake line is blocked.

Load-sensing systems monitor the operation of an electric motor and determine the power level that the motor is producing. These systems detect overload and underload conditions. Such systems can shut off the motor in response to sensing an undesirable overload or underload condition. The intended purpose of these systems is to protect against damage to the motor or to an associated, powered machine or the product being produced by the machine. Such systems also can prevent waste of electrical power. The following patents illustrate this type of load-sensing system.

U.S. Pat. No. 4,123,792 to Gephart et al. shows a load sensing system that monitors an electronic signal proportional to the mechanical power output of the motor. This signal is detected by rectifying a signal that is an analog of motor current in phase with the motor voltage and time averaging the rectified signal. Comparing the averaged signal to a reference level permits the interruption of motor current for an underload or an overload condition. The circuit permits detection of excessive ice formation on an outdoor heat exchanger of a heat pump system. The circuit is connected to an impeller drive motor that forces air across the heat exchanger. The circuit stops the motor and initiates a de-ice procedure when ice blockage causes mechanical power delivered by the motor to deviate to a selected level.

U.S. Pat. No. 4,419,625 to Bejot et al. shows a device that determines the mean power absorbed from a current supply by measuring the current in a phase and the voltage between two phases, determining the product of the two, and integrating the product. A first potentiometer provides a proportion of the voltage, which is an image of the current, and subtracts it from that voltage between phases. A second potentiometer provides a proportion of the voltage between phases and subtracts if from the product. A third potentiometer provides a proportion of a constant voltage and subtracts it from that product. The third potentiometer is adjusted so that the output power of the integrator is zero when the motor rotates under no-load condition.

U.S. Pat. No. 5,473,497 to Beatty shows a device for measuring energy delivered by a motor to a load. The device is connected to the motor, which is coupled to the load and connected to a power source through first and second power supply lines. The device includes a line voltage sensing circuit for sensing the voltage across the power supply lines, a line current sensing circuit for sensing the current flowing through the motor, and a pulse width modulator that modulates the sensed voltage to produce a pulse width modulated first electrical signal. The device also includes a first switch, responsive to the pulse width modulated first electrical signal, which modulates an output of the line current sensing circuit to produce a power waveform. An integrator integrates the power waveform to produce an output signal indicative of the energy delivered by the motor to the load. The device further includes a switch controller that compares the output signal to a first reference signal to detect the existence of an overload condition. The switch controller compares the output signal to a second reference signal to detect the existence of an underload condition. The switch controller opens a second switch to disconnect the motor from the power source in response to either an overload condition or an underload condition.

U.S. Reissue Pat. RE 33,874 to Miller shows an underload protection system for an electric motor connected to first and second power supply lines, wherein the lines are connectable to an AC power supply. The system provides a line voltage sensing circuit connected to the first power supply line. The sensing circuit has a line voltage signal impressed thereon. An amplitude adjustment circuit is connected to the voltage sensing circuit for adjusting the line voltage signal to produce an amplitude adjusted voltage signal. A line current sensing circuit is connected to the second line and has a line current signal impressed thereon. A phase adjustment circuit is connected to the current sensing circuit for adjusting the phase of the current signal to produce a phase adjusted current signal. A phase responsive circuit is connected to the amplitude adjustment circuit and to the phase adjustment circuit for producing an adjusted power factor signal. A disconnect circuit is connected to the phase responsive circuit for disconnecting the power lines when the power factor is below a preset value.

It would be desirable to employ load-sensing technology as an accurate and responsive technique for determining occurrence of an aquatic suction entrapment event.

To achieve the foregoing and other objects and in accordance with the purpose of the present invention, as embodied and broadly described herein, the method and apparatus of this invention may comprise the following.

SUMMARY OF THE INVENTION

Against the described background, it is therefore a general object of the invention to provide an SVRS that can retrofit substantially any swimming pool circulation system by the direct substitution of the circulation pump motor, thereby requiring substantially no expansion of equipment space, housings, and the like.

An object of the present invention is to provide an SVRS that protects the pump against damage that can result from running dry. Correspondingly, this SVRS maintains the continuity of the water content of the circulation system and does not introduce air into the circulation system. Similarly, this SVRS does not cause the pump to lose prime, thereby enabling the circulation system to restart with minimum difficulty.

Another object is to provide an SVRS that requires no hydraulic connections to the fluid circulation system of the swimming pool. Unique to this invention is that this SVRS is non-invasive because it is not in direct fluid communication with the circulation system and requires no hydraulic connections. Connections like pressure sensor lines, reversing valves, and pressure relief valves are not needed with this invention.

A further object of the present invention is to enable the efficient and economical design or upgrade of pool circulation systems by the suitable selection of a motor equipped with load-sensor. The relatively simple selection or exchange of a motor is far more economical than installing supplemental piping, valves, and other bulky equipment not previously required.

A specific object is to provide an SVRS that can be completely built into and incorporated within a swimming pool pump motor.

A similar object is to provide an SVRS that can be retrofitted to a swimming pool simply by changing out a circulation pump motor, which is a relatively standard maintenance procedure for any pool.

An important object is to provide a readily available and easily implemented solution to suction entrapment, which swimming pool pump manufacturers can incorporate into their pumps with little burden on established practices.

An additional object is to provide an SVRS that is likely to be of exceptionally low cost, thus enabling a greatly increased range of pool owners to improve the safety of their pools by outfitting the pools with an SVRS.

Another object is to expand the scope of applications for electric motor load-sensing technology to include this new application as a life saving device for swimming pools.

According to one aspect of the invention, an aquatic facility is equipped with a safety vacuum release system that detects underload of the motor powering the circulation pump. The facility provides an aquatic vessel that contains a body of water having at least one circulation drain near a bottom of the aquatic vessel. A circulation pump has an intake side for drawing water out of the aquatic vessel and an output side for directing water back into the aquatic vessel. A suction line interconnects the drain and the intake side of said circulation pump, and a return line interconnects the vessel and the outlet side of the circulation pump. An electric motor operates the circulation pump when said motor operates and shuts off the pump when the motor is shut off. A suitable load sensor device connected to the motor detects underload of the electric motor indicative of a blockage at the suction line, and the load sensor controls a switch upon the detection of suitable underload to shut off the motor.

Another aspect of the invention provides a method of detecting a suction entrapped blockage at a suction outlet fitting serving the intake side of a circulation pump of an aquatic facility and releasing the blockage. The method steps include powering the circulation pump by an electric motor; sensing a load factor of the electric motor for detecting a suitable underload condition indicative of a blockage held by vacuum at a suction outlet fitting; shutting off the electric motor in response to detection of the underload condition; and releasing the blockage at the suction outlet fitting by retaining the motor in shut-off status for a time sufficient to allow the vacuum to neutralize.

The accompanying drawings, which are incorporated in and form a part of the specification, illustrate preferred embodiments of the present invention, and together with the description, serve to explain the principles of the invention. In the drawings:

DETAILED DESCRIPTION

Figure 1:
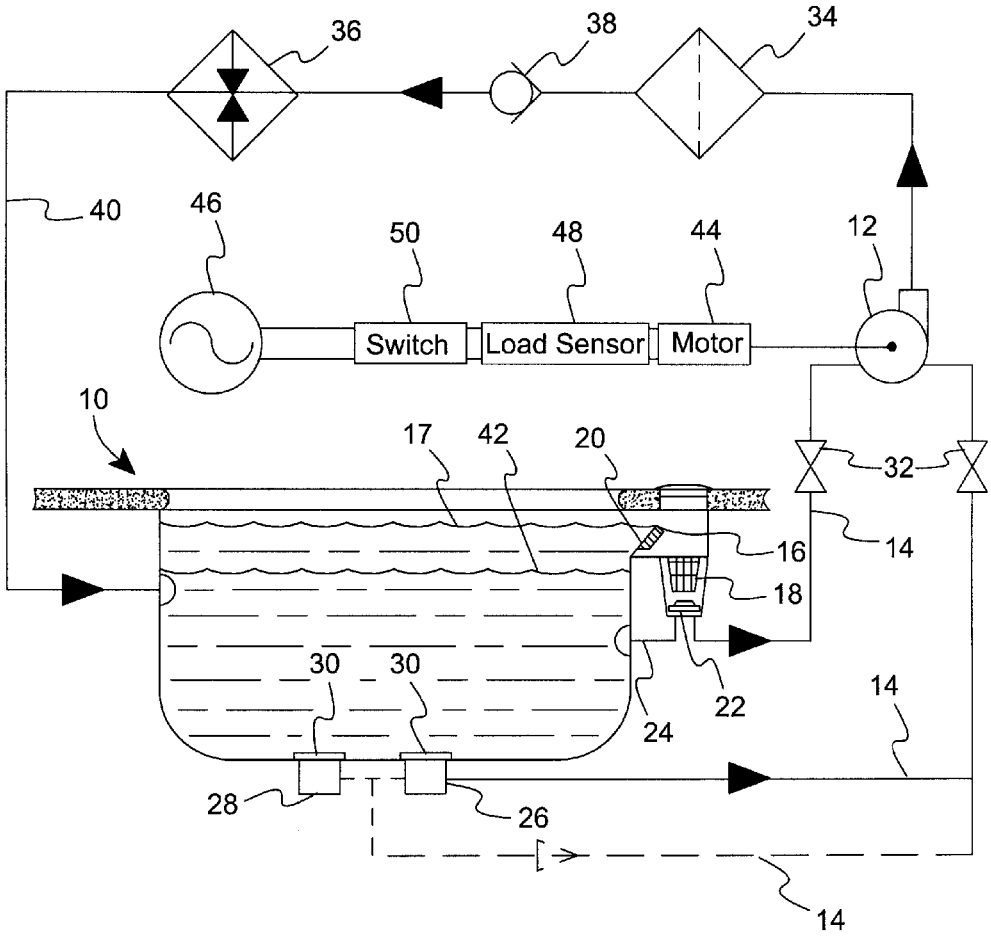
FIG. 1 is a schematic diagram of a swimming pool with SVRS built into the water circulation system according to the invention.

The present invention is a safety vacuum release system (SVRS). An SVRS is an automatic safety system in an aquatic facility such as a swimming pool, spa, wading pool, or like aquatic vessel that in use contains a body of water. Such a system automatically releases a blocking object that blocks a single-sourced circulation pump. Typically, the blockage is a bather who has become trapped onto a suction outlet fitting, which typically communicates through a suction conduit with a circulation pump. Via the conduit, the circulation pump typically found in an aquatic facility is capable of producing a dangerously high vacuum level at a suction outlet fitting if intake flow to the pump is blocked. The level of suction can be high enough that a bather cannot free himself from a suction outlet fitting unless assisted by a SVRS. Suction entrapment can drown or otherwise injure a trapped bather unless the victim is quickly released.

Load-sensing systems such as those referred to, above, have been used to monitor the electrical power factor of a motor. It has now been discovered that when a motor controlled by a load sensor is connected to operate a circulation pump such as those used in swimming pools and the like, the load sensor operates in a new way as an SVRS. Despite the fact that the pump remains charged with water during a vacuum entrapment event, the motor changes shaft speed in a manner that the load sensor detects. Shaft speed increases as load is reduced. Thus, the load sensor becomes a monitor for motor shaft speed (RPM).

Incorporation by reference—Suitable load sensors are generally disclosed by U.S. Pat. No. 4,123,792 to Gephart et al. issued Oct. 31, 1978, U.S. Pat. No. 4,419,625 to Bejot et al. issued Dec. 6, 1983, U.S. Pat. No. 5,473,497 to Beatty issued Dec. 5, 1995, and U.S. Reissue Pat. RE 33,874 to Miller issued Apr. 7, 1992. Each of these patents is incorporated by reference herein for disclosure of load sensor technology.

A load sensor measures the power factor of a motor. The load sensor output can produce an accurate reading of the percentage of the electrical current passing through the motor that is converted into useful load or power that is transferred to the attached circulation pump. Load-sensors are commercially produced as stand alone components that can be attached to any motor. In addition, some motors include an integrated load sensor. Particularly the latter allows the substitution of a motor with integral load sensor into a space that previously housed a motor without load sensor.

During an aquatic suction entrapment event, a trapped bather or other blockage stops water flow into a suction outlet fitting of an aquatic facility. Typically, in order for suction entrapment to occur, the circulation pump must have become single-sourced to a single suction outlet fitting, such that the pump receives all intake of water from the single fitting. When the blockage closes off the final suction outlet fitting, vacuum or negative pressure abruptly increases within the intake pipe to the circulation pump. The high level of vacuum is communicated from the pump to the victim through the conduit that connects the pump to the blocked suction outlet fitting inside of the swimming pool.

Simultaneously with the entrapment event, water flow within the circulation system abruptly decreases or stops. As a result, the pump is moving a substantially decreased volume of water. Correspondingly, the electric pump motor sees an abruptly decreased load accompanied by a corresponding increase in RPM. The load sensor on the pump motor senses the aquatic suction entrapment event by detecting the abruptly decreased load factor for the electric motor that drives the circulation pump. This method of operating an SVRS eliminates the need to monitor vacuum level for the intake line.

The load sensor is configured to shut off the circulation pump motor upon detecting a predetermined level of motor underload condition. Extensive testing has established that a motor underload condition will result as a reliable indication of a flow blockage at the pump intake that is severe enough to be unsafe for bathers. Thus, a load sensor controlling a motor and monitoring underload condition will perform as an SVRS that, in the event a bather has become trapped, shuts off the motor and hence the circulation pump. With the circulation pump stopped, the resulting dangerously high level of vacuum quickly neutralizes. By the use of normal controls, the motor and load sensor can be configured to require either a manual reset or automatic reset after a predetermined amount of time, such as five minutes, has elapsed since the load sensor shut off the motor.

The preferred embodiment of the invention provides a load sensor that is integrated within the circulation pump motor at the time of manufacture. Such a motor can be easily and universally fit into any swimming pool, because all swimming pools have a circulation pump motor.

This SVRS load-sensor is specifically adjusted to shut off the motor in an underload situation. Extensive testing has shown that underload is indicative of a characteristic loss of water flow that motor RPM increase that accompanies a suction entrapment event. Further, the load sensor must be adjusted to reliably pass official standards for SVRS devices. Testing standards bodies such as ASTM or ANSI establish a standard for SVRS performance without failure. These standards provide the official protocol for testing an SVRS in order to gain ASTM or ANSI approval. The procedure calls for testing the SVRS in a variety of hydraulic situations. Water is supplied to a test pump from a single, standard, eight-inch aquatic suction outlet fitting. With the test pump in operation, a blocking element with fifteen pounds of buoyancy is repeatedly placed over the suction outlet fitting to simulate a series of suction entrapment events. The SVRS must successfully release the blocking element within 3 seconds in each and all of the tests without failure.

When a suction entrapment event occurs, a bather has blocked the water flow into a suction outlet fitting within a swimming pool, stopping flow to the circulation pump. The stoppage of water flow causes the pump to create an extremely high level of vacuum at the pump intake. This high level of vacuum is transmitted through the stationary water within the suction pipe to the suction outlet fitting, where the victim has become trapped. Typically any standard swimming pool pump, regardless of the horsepower rating of the pump motor, will create in excess of twenty-four inches HgR vacuum when the pump intake is blocked. Every square inch of area of adhesion between the fitting and the victim has an adhesion force of over eleven pounds. This vacuum or negative pressure, rather than the loss of water flow, is the lethal force that can cause an accident such as injury or drowning death to a bather.

When a suction entrapment event occurs, the vacuum level increases, and the flow of water decreases within the suction pipe. The vacuum level is inversely proportional to the flow of water. The load or power transferred by the electric motor to the pump is proportional to the flow of water but not to the vacuum level nor to the relative fluid pressure within the circulation system. The SVRS senses the load, which is fundamentally determined by the volume of water flowing through the pump. Therefore, when a bather is trapped, and in contrast to prior art SVRSs, this SVRS reacts to the loss of water flow rather than to an increase in vacuum level. The invention includes this new method for operating an SVRS.

The SVRS operates to detect a suction entrapment event by sensing the percentage of electrical power being consumed by the pump motor. The load sensor converts this sensed value to load or power factor. In an SVRS with programmable operation, a shut off setting typically in the range from 55% to 62% has been found suitable and appropriate. If suction flow blockage occurs, the water flow to the pump is interrupted or greatly restricted. The electric pump motor is underloaded. In this situation, the load sensor senses the underload condition and shuts off the pump motor. As a result, the high vacuum level created by the operating pump, accompanying the flow blockage, neutralizes, releasing the victim.

A novel aspect of the invention is that the SVRS reacts to hydraulic situations within the pump without having any direct fluid communication with the water flow path.

With reference to FIG. 1, an aquatic facility or vessel such as a swimming pool 10 includes a water circulation system. A specially configured circulation pump 12 operates this system. Normally the pump 12 is a centrifugal pump. One or more conduits or suction lines such as pipelines 14 are connected for communication between the pool and the intake side of pump 12, such that the pump 12 draws water through pipelines 14. Various suction outlet fittings at the pool provide water into the pipelines 14.

For example, a skimmer 16 provides water from the typical water surface level 17 when the pool is full. A skimmer includes a basket 18 for catching floating debris from the pool surface. A weir 20 helps to retain the debris in the skimmer. Below the basket, a float valve 22 controls the skimmer, and a section equalizer line 24 connects the bottom of the skimmer back to the pool.

A circulation drain 26 on the bottom of the pool provides water to the pump 12. A second drain 28 is beneficial for safety reasons, to help avoid suction entrapment that could be caused by a single-source pump intake. Pool drains 26, 28 should include suction outlet safety covers 30.

The circulation system directs water flow through a circuit. Suction valve manifolds 32 between the pool and the intake side of the pump control incoming flow. The outlet side of the pump feeds water to a filter 34. In turn, water flows from the filter to an optional heater 36. In some circulation systems, a check valve 38 might be installed between the heater 36 and filter 34 prevents reverse flow of heated water into the filter. Check valves 38 should be removed to better allow vacuum level to neutralize quickly when the pump motor stops. After passing through the filter and heater, the water flows back into the pool through a return line 40.

Suction entrapment can occur if the pump 12 becomes single-sourced, drawing all of its water from one suction outlet fitting, such as at a single drain 26. A pump can become single-sourced by a variety of circumstances. For example, a skimmer 16 sometimes is installed without an equalizer line 24. The omission of the equalizer line 24 allows a plugged basket 18 to block the skimmer 16. Similarly, a low water level 42 or a jammed weir 20 can close the float valve 22. In any of these circumstances, the skimmer 16 ceases to perform as a water source to pump 12 and contributes to the possibility that the pump will become single-sourced.

A variety of other events can result in the pump 12 becoming single-sourced or otherwise contribute to a suction entrapment event. Dual drains 26, 28 can provide a measure of safety against the pump becoming single-sourced. However, if two bathers simultaneously block the dual drains, entrapment can occur. Pool control valves such as suction valve manifolds 32 accidentally can be set for single-sourced operation. In circulation systems where check valve 38 has not yet been removed, the check valve can interfere with the operation of an SVRS by maintaining the high vacuum even after the pump motor is shut off. Consequently, check valves 38 should be removed from a circulation system. Missing suction outlet safety covers 30 also can contribute to the likelihood of a suction entrapment event.

If a bather should block the single-source fitting, an entrapment accident can result. Swimming pool pumps can be quite powerful as compared to pumps use only a few decades ago, causing an increased risk of suction entrapment. A standard eight-inch drain cover, if single-sourced to a one horsepower pump, can produce three hundred fifty pounds of entrapment force. Four feet of depth can add another fifty-five pounds of force. A twelve-inch drain cover can transmit over sixteen hundred pounds of adhesion force to an entrapped victim.

An electric motor 44 powers the circulation pump 12. Motor 44 typically is connected to the AC power grid 46 to draw line voltage and current. A load sensor 48 operates to detect underload and to shut off the motor when underload is detected. The load sensor 48 controls a switch 50 that shuts off the motor from the AC grid. Motors with built-in load sensor are produced by various commercial sources.

Figure 2:
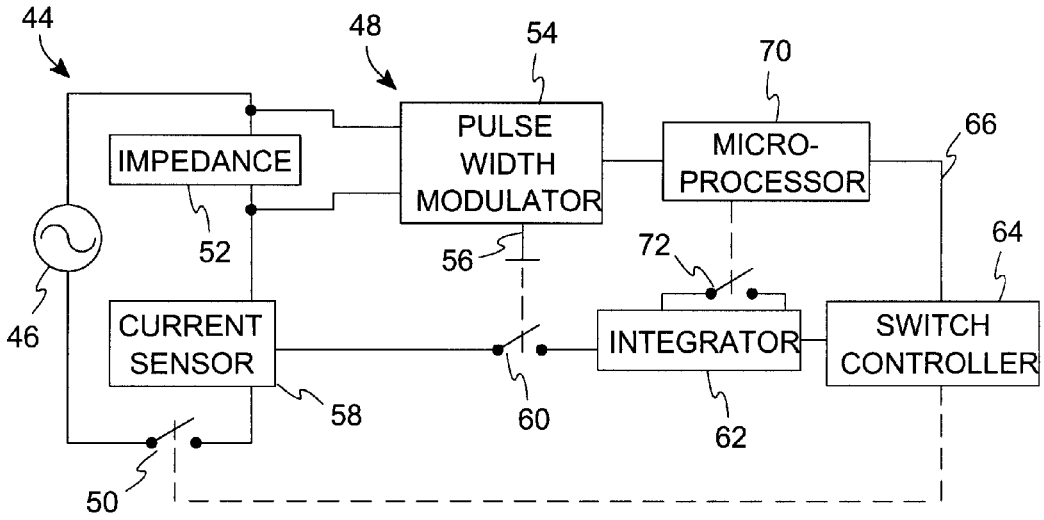
Fig. 2 (PRIOR ART)
FIG. 2 is a block diagram of a motor system including a load sensor according to the invention.

As an example of a modern, commercial load sensor, the block diagram of FIG. 2 shows a motor system 44 of impedance 52 in combination with a load sensor system 48 suitable to shut off the electric motor system upon detecting a suitable underload. The load sensor 48 detects motor underload when coupled to reference levels. The load sensor 48 develops first and second electrical signals indicative of first and second parameters of power delivered to the load, pulse width modulates the first electrical signal to produce a pulse width modulated first electrical signal, and modulates the second electrical signal in accordance with the pulse width modulated first electrical signal to produce a power waveform. The load sensor 48 then integrates the power waveform to produce an output signal indicative of the energy delivered by the motor 44 to the load.

Pulse width modulator 54 senses the line voltage appearing across the impedance 52 and produces a voltage signal that is a pulse width modulated version of the line voltage. This pulse width modulated voltage signal is developed at a pulse width modulator output 56. The AC line voltage is modulated by the pulse width modulator 54 during each of either the positive half-cycles or negative half-cycles of the line voltage so that the pulse width modulated voltage signal comprises a set of pulses at times corresponding to each of either the positive half-cycles or negative half-cycles and a value of zero at times corresponding to the other of the positive half-cycles or negative half-cycles.

A current sensor 58 detects the line current that flows through the motor 44 and delivers a current signal indicative of line current to a switch 60. The switch 60 modulates the current signal and is controlled in accordance with the pulse width modulated voltage signal produced by the pulse width modulator 54 at the pulse width modulator output 56 such that the switch 60 is closed during each pulse of the pulse width modulated voltage signal and is open at all other times. In this manner, the switch 60 effectively multiplies the voltage appearing across the motor impedance 52 with the current flowing through the motor 44 during every other half-cycle of the line voltage to produce a modulated current signal indicative of the real power delivered by the power source 46 to the motor 44.

An integrator 62 integrates the modulated current signal developed by the switch 60 to produce an energy waveform that is indicative of the energy delivered to the motor 44 during each positive half-cycle or negative half-cycle of the line voltage and, therefore, that is indicative of the energy delivered by the motor 44 to pump 12. The energy waveform developed by the integrator 62 is delivered to a switch controller 64 that latches the final value of the energy waveform in response to a signal developed, for example, on a line 66, and compares the latched value with a predetermined level to detect a motor underload condition. If the amplitude of the energy waveform is below a predetermined reference level, an underload condition is detected and the switch controller 64 opens the switch 50 to disconnect the power source 46 from the motor 44. In this manner the motor 44 provides the function of an SVRS during a suitable underload condition.

The integrator 62 is reset by a microprocessor 70 in conjunction with a switch 72. The microprocessor 70, which inherently contains or enables a clock function or timing means, counts the cycles of the line voltage appearing across the impedance and produces a reset signal after a predetermined number of line cycles. The reset signal closes the switch 72 in order to reset the integrator 62 and thereby to reset the energy waveform to a value of zero. The microprocessor 70 can reset the integrator 62 every half-cycle so that the integrator 62 produces an energy waveform indicative of the energy delivered to the motor 44 during any particular line voltage half-cycle or, alternatively, the microprocessor 70 can reset the integrator 62 after a predetermined number of line cycles. The latter configuration enables the integrator 62 to integrate the modulated current signal produced by the switch 60 over a number of consecutive line cycles, enabling the load sensor 48 to measure comparatively small amounts of energy over a number of line cycles to produce an accurate indication of the motor loading condition. The microprocessor 70 produces a latching signal on the line 66 prior to resetting the switch 72. The latching signal enables the switch controller 64 to latch the energy waveform produced by the integrator 62.

Alternatively, the operation of the switch controller 64 can be performed by the microprocessor 70. In this alternative, the output of the integrator 62 is converted into a digital signal by an A/D converter (not shown). The digital signal is provided to the microprocessor 70, which determines whether an underload condition exists by comparing the signal with a reference load value. In this alternative, the microprocessor 70 directly controls the switch 50 in order to disconnect power from the motor 44 when an underload condition occurs.

In load sensors using a microprocessor 70, programming readily sets the shut off period of the switch controller 64. For use as an SVRS, the programming should call for a predetermined shut off period on the order of five minutes. This period provides adequate time to an entrapped bather to recover and remove himself from the suction outlet fitting. Thus, it is adequate and acceptable for the circulation pump motor to restart automatically after a five-minute shut off cycle. The microprocessor 70 can monitor the shut off period by use of its contained timing function. After the predetermined period, the microprocessor can signal the switch controller 64 to close switch 50 and thereby restart the pump motor 12.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention.

What is claimed is:

1. A method for the release of a bather trapped below a water level in an aquatic vessel having a water circulation system, the trapped bather being suction entrapped at a submerged suction outlet fitting and in danger of drowning below the water level of the aquatic vessel by a dangerously high level of vacuum at the submerged suction outlet fitting, the method comprising:

delivering water from the aquatic vessel to a centrifugal pump via an intake pipe of the water circulation system;

charging the centrifugal pump with the water from the aquatic vessel;

returning water from the centrifugal pump to the aquatic vessel through a return pipe;

circulating water in the water circulation system with the centrifugal pump powered by an electric motor;

remotely and indirectly sensing a potential for a dangerously high vacuum level within the intake pipe without using a sensor to sense either water flow or water pressure characteristics within the intake pipe, centrifugal pump or return pipe; and reacting to a loss of flow of water independent of any direct fluid communication with the loss of flow of water by powering down the electric motor causing the dangerously high vacuum level within the intake pipe to neutralize the dangerously high vacuum level and to release the trapped bather from the submerged suction outlet fitting, the centrifugal pump remaining continuously charged with water and with no air being introduced into the water circulation system.

2. The method of claim 1 wherein the remotely and indirectly sensing operation includes determining the rotations per minute (RPM) of the electric motor.

3. A safety vacuum release system for an aquatic vessel used for bathing, the safety vacuum release system being structured and arranged to detect a loss of water flow caused by a blockage of a submerged suction outlet fitting creating a potential for the occurrence of a dangerous vacuum level at the submerged suction outlet fitting capable of entrapping a bather, thereby causing injury or death, the safety vacuum release system comprising:

a water circulation system including a centrifugal pump for circulating water to and from the aquatic vessel;

an electric motor operably connected to the centrifugal pump to drive the centrifugal pump;

a water intake pipe having a receiving end connected to the submerged suction outlet fitting which a bather could come in physical contact with, and a discharge end connected to an intake side of the centrifugal pump to provide a flow of water from the aquatic vessel into the centrifugal pump;

a water return pipe connected to a discharge side of the centrifugal pump on a receiving end, and to the aquatic vessel on a discharge end to provide a flow of water from the centrifugal pump back to the aquatic vessel; and a motor load-sensor operably and directly attached to the electric motor, disposed away from any direct fluid communication with water flow to sense a level of load of motor output, and configured to interrupt electrical power to the electric motor if a decrease in motor load predetermined to indicate a loss of water flow occurring by the bather being suction entrapped against the suction outlet fitting and causing a blockage of water flow, the interruption shutting off the centrifugal pump to avoid the occurrence of the dangerous vacuum by quickly neutralizing the vacuum level, thereby releasing the bather.

4. The safety vacuum release system of claim 3 wherein the water circulation system stays fully charged with water throughout operation of the safety vacuum release system by not introducing air as part of the release mechanism.

5. The safety vacuum release system of claim 3 wherein the motor load-sensor is configured to determine the rotations per minute (RPM) of the electric motor.

6. A safety vacuum release system for an aquatic vessel used for bathing, the safety vacuum release system being structured and arranged to detect a potential for a dangerously high level of vacuum at a submerged suction outlet fitting which a bather can come into physical contact with, the high level of vacuum being capable of entrapping the bather and causing injury or death, the system comprising:

a centrifugal pump for circulation of water to and from the aquatic vessel, the centrifugal pump having an intake pipe connection and a discharge pipe connection;

an electric motor operably connected to the centrifugal pump to drive the centrifugal pump, the electric motor being configured to operate at an underload state when the centrifugal pump is operating charged with water and a loss of flow of water occurs at the intake pipe connection;

an intake pipe connected to the intake pipe connection of the centrifugal pump at one end and connected to the submerged suction outlet fitting at the other end, the intake pipe having a path for water flow between the ends, the intake pipe being configured and arranged to have a loss of water flow when the submerged suction outlet fitting is blocked, thereby giving rise to the potential for the dangerously high vacuum level capable of trapping a bather;

a return pipe configured to direct water to the aquatic vessel from the centrifugal pump, and connected to the discharge pipe connection of the centrifugal pump, the centrifugal pump, the intake pipe and the return pipe being free of any sensors sensing water flow and/or water pressure characteristics which are part of the safety vacuum release system;

a motor load-sensor operably connected to the electric motor and disposed away from direct fluid communication with water flow and detached from any direct connection with relative fluid pressure within the water circulation system, the motor load-sensor being configured to sense the underload state which accompanies the loss of flow of water indicative of the potential for the dangerously high vacuum level; and a switch operably connected to the electric motor and the motor load-sensor, the motor load-sensor being configured to control the switch to shut off the electric motor in response to the loss of water flow indicative of the potential for the dangerously high level of vacuum at the submerged suction outlet fitting, independent of any direct fluid communication with the path for water flow for the purpose of neutralizing the high level of vacuum to free an entrapped bather.

7. The safety vacuum release system of claim 6 wherein the centrifugal pump stays fully charged with water throughout operation of the safety vacuum release system by not introducing air as part of the release mechanism.

8. The safety vacuum release system of claim 6 wherein the motor load-sensor is configured to determine the rotations per minute (RPM) of the electric motor.

9. A method for the release of a bather trapped below a water level in an aquatic vessel, the trapped bather being suction entrapped and in danger of drowning below the water level of the aquatic vessel by a dangerously high level of vacuum, the method comprising:

receiving water from the aquatic vessel at a centrifugal pump via an intake pipe connection of the centrifugal pump;

charging the centrifugal pump with water from the aquatic vessel;

outputting water from the centrifugal pump to the aquatic vessel through a return pipe connection;

circulating water in a water circulation system with the centrifugal pump powered by an electric motor;

remotely and indirectly sensing a potential for a dangerously high vacuum level at the intake pipe connection without using a sensor to sense either water flow or water pressure characteristics within the intake pipe connection, centrifugal pump or return pipe connection; and reacting to a loss of flow of water independent of any direct fluid communication with the loss of flow of water by powering down the electric motor causing the dangerously high vacuum level at the intake pipe connection to neutralize the dangerously high vacuum level and to release the trapped bather, the centrifugal pump remaining continuously charged with water and with no air being introduced into the water circulation system.

10. A safety vacuum release system for an aquatic vessel used for bathing, the safety vacuum release system being structured and arranged to detect a loss of water flow caused by a blockage of a submerged suction outlet fitting creating a potential for the occurrence of a dangerous vacuum level at the submerged suction outlet fitting capable of entrapping a bather, thereby causing injury or death, the safety vacuum release system comprising:

a water circulation system including a centrifugal pump for circulating water;

an electric motor operably connected to the centrifugal pump to drive the centrifugal pump;

a water intake pipe connection on intake side of the centrifugal pump configured to receive an intake pipe having a receiving end connected to the submerged suction outlet fitting at which a bather could come in physical contact and a discharge end to provide a flow of water into the centrifugal pump;

a water return pipe connection on a discharge side of the centrifugal pump configured to receive a return pipe having a receiving end and a discharge end to provide a flow of water from the centrifugal pump; and a motor load-sensor operably attached to the electric motor, the motor load-sensor being disposed away from any direct fluid communication with water flow to sense a level of load of motor output and configured to interrupt electrical power to the electric motor if there is a decrease in motor load predetermined to indicate a loss of water flow occurring by the bather being suction entrapped against the suction outlet fitting and causing a blockage of water flow, the interruption shutting off the centrifugal pump to avoid the occurrence of the dangerous vacuum by quickly neutralizing the vacuum level, thereby releasing the bather.

* * * * *

(12) INTER PARTES REVIEW CERTIFICATE (47th)

United States Patent
Cohen

(10) Number: US 8,281,425 K1
(45) Certificate Issued: Dec. 10, 2014

(54) LOAD SENSOR SAFETY VACUUM RELEASE SYSTEM

(75) Inventor: Joseph D. Cohen

(73) Assignee: Hayward Industries, Inc.

Trial Numbers:

IPR2014-00187 filed Nov. 22, 2013
IPR2014-00190 filed Nov. 22, 2013

Petitioners: Pentair Ltd.; Pentair Water Pool and Spa, Inc.

Patent Owner: Hayward Industries, Inc.

Inter Partes Review Certificate for:

Patent No.: 8,281,425
Issued: Oct. 9, 2012
Appl. No.: 11/163,860
Filed: Nov. 1, 2005

The results of IPR2014-00187 and IPR2014-00190 are reflected in this inter partes review certificate under 35 U.S.C. 318(b).

INTER PARTES REVIEW CERTIFICATE
U.S. Patent 8,281,425 K1
Trial No. IPR2014-00187
Certificate Issued Dec. 10, 2014

AS A RESULT OF THE INTER PARTES REVIEW PROCEEDING, IT HAS BEEN DETERMINED THAT:

Claims 1-10 are cancelled.

* * * * *